United States Patent [19]

McKay et al.

[11] Patent Number: 4,799,916

[45] Date of Patent: Jan. 24, 1989

[54] MOTORLESS TOY VEHICLE AND PROPELLING TRACK

[76] Inventors: Robert S. McKay, 7420 Beckwith Rd., Morton Grove, Ill. 60053; Dennis R. Dahm, 632 Oriole Dr., Streamwood, Ill. 60107

[21] Appl. No.: 205,740

[22] Filed: Jun. 13, 1988

[51] Int. Cl.[4] ..... A63H 18/00; A63H 19/28; B61B 13/00; B61C 11/00

[52] U.S. Cl. ..... 446/444; 446/467; 104/118; 104/140; 104/162; 104/DIG. 1; 105/1.5; 105/29.2; 105/112; 105/124; 74/130

[58] Field of Search ..... 446/444, 445, 446, 447, 446/448, 449, 467, 473, 238, 239, 232; 104/162, 118, 140, 242, DIG. 1, 165, 243, 248; 105/1.5, 29.2, 112, 124, 29.1, 127; 74/130, 126, 133

[56] References Cited

U.S. PATENT DOCUMENTS

| | | | |
|---|---|---|---|
| 387,914 | 8/1888 | Pendleton | 104/162 X |
| 1,541,589 | 6/1925 | Rossini | 446/444 X |
| 1,997,512 | 4/1935 | Einfalt | 446/444 X |
| 2,507,681 | 5/1950 | Sage | 74/130 X |
| 3,379,138 | 4/1968 | Lindstrom | 446/444 X |
| 3,422,941 | 1/1969 | Fredell | 74/126 X |
| 3,477,172 | 11/1969 | Polewski | 446/445 |
| 3,589,205 | 6/1971 | Radovic | 105/127 X |
| 3,688,436 | 9/1972 | Wakimura | 446/447 X |
| 3,930,333 | 1/1976 | De Anda | 446/445 |
| 3,998,460 | 12/1976 | Dyer | 446/444 X |

FOREIGN PATENT DOCUMENTS

| | | | |
|---|---|---|---|
| 3444426 | 6/1986 | Fed. Rep. of Germany | 446/444 |
| 442679 | 11/1948 | Italy | 446/444 |
| 522534 | 6/1940 | United Kingdom | 104/162 |
| 1189250 | 4/1970 | United Kingdom | 446/444 |

*Primary Examiner*—Robert A. Hafer
*Assistant Examiner*—D. Neal Muir
*Attorney, Agent, or Firm*—Charles J. Prescott

[57] ABSTRACT

A motorless toy vehicle and propelling track. The toy vehicle includes a gear housing having a drive system, the drive system including a drive gear and a ratchet means for controlling the direction of rotation of the drive gear. The track is adapted to receive and laterally direct the toy vehicle as it passes there along and includes a rack coextensive with the track having upwardly disposed teeth there along which operably engage with the drive gear. A rack drive reciprocates the rack back and forth in the track interacting with the ratcheted drive gear to propel the toy vehicle in the direction determined by the position of the ratchet means. Hill and switch tracks are also provided.

12 Claims, 3 Drawing Sheets

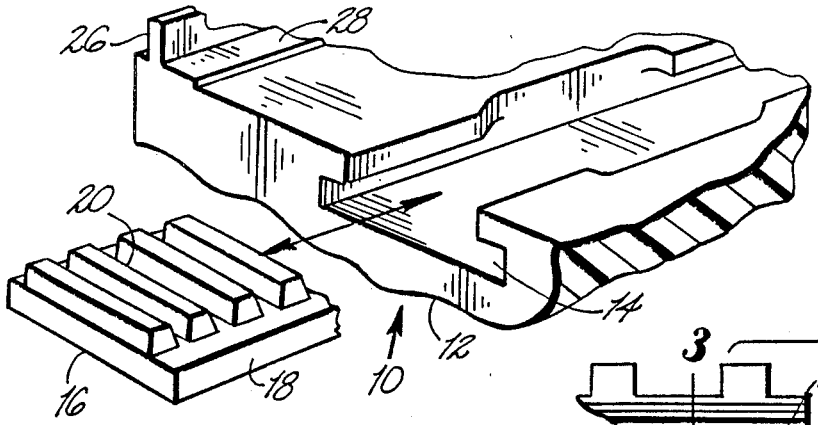
Fig. 1
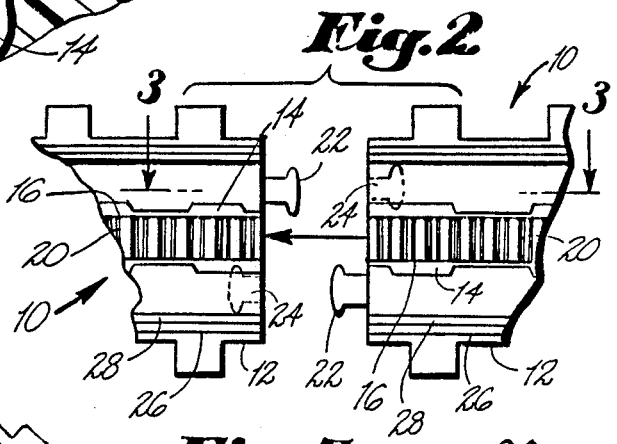
Fig. 2
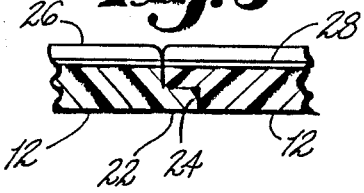
Fig. 3
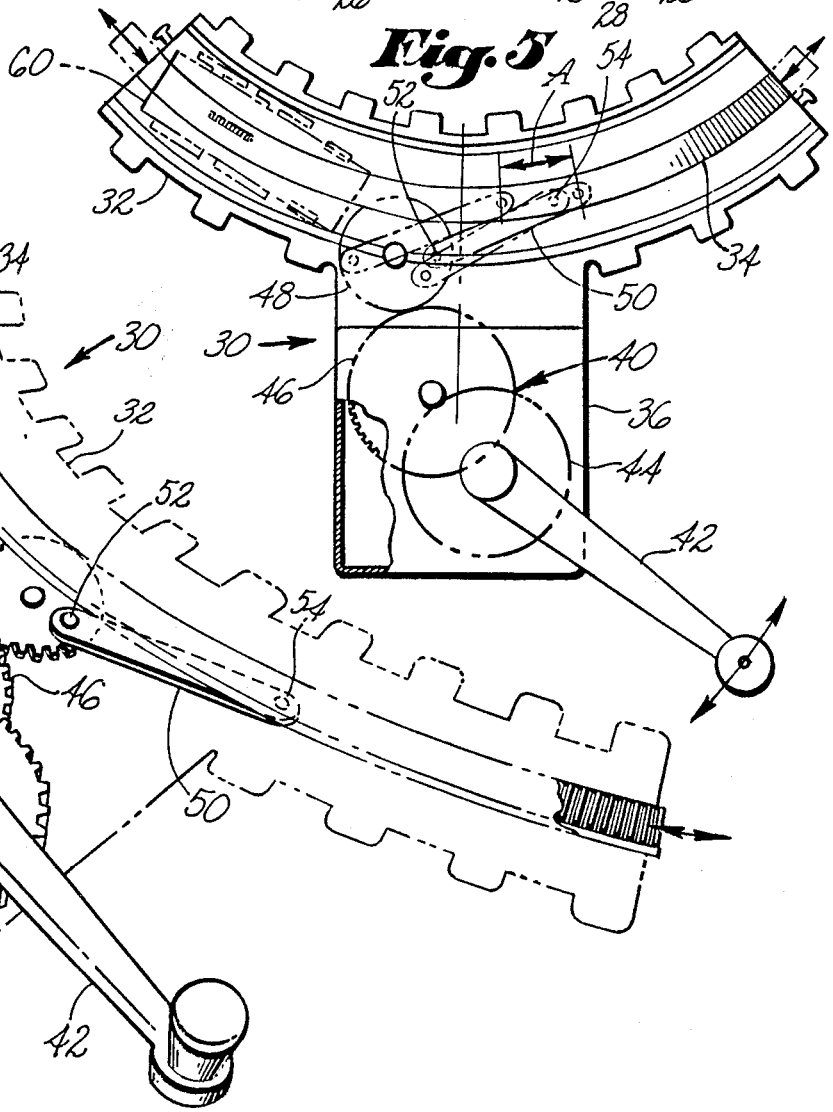
Fig. 5
Fig. 4

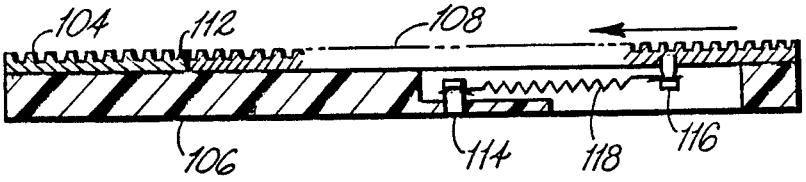
Fig. 12
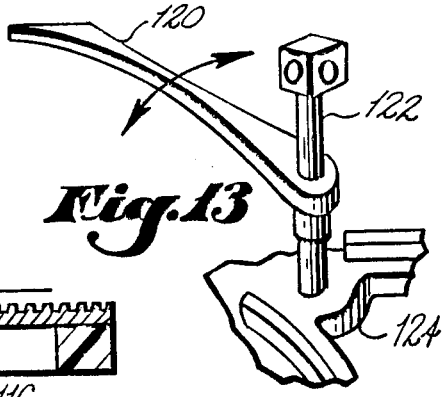
Fig. 13
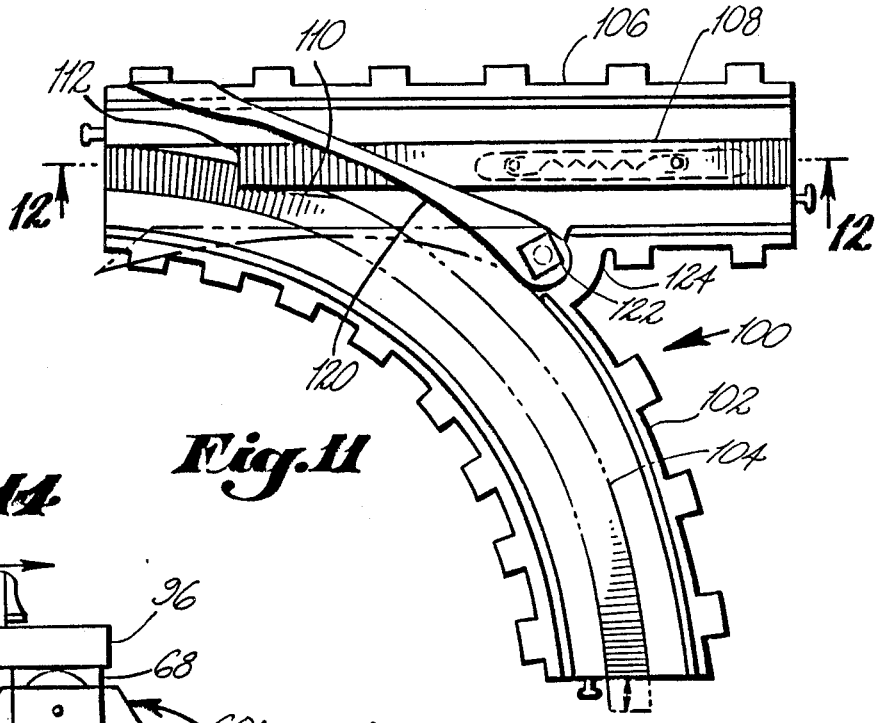
Fig. 11
Fig. 14
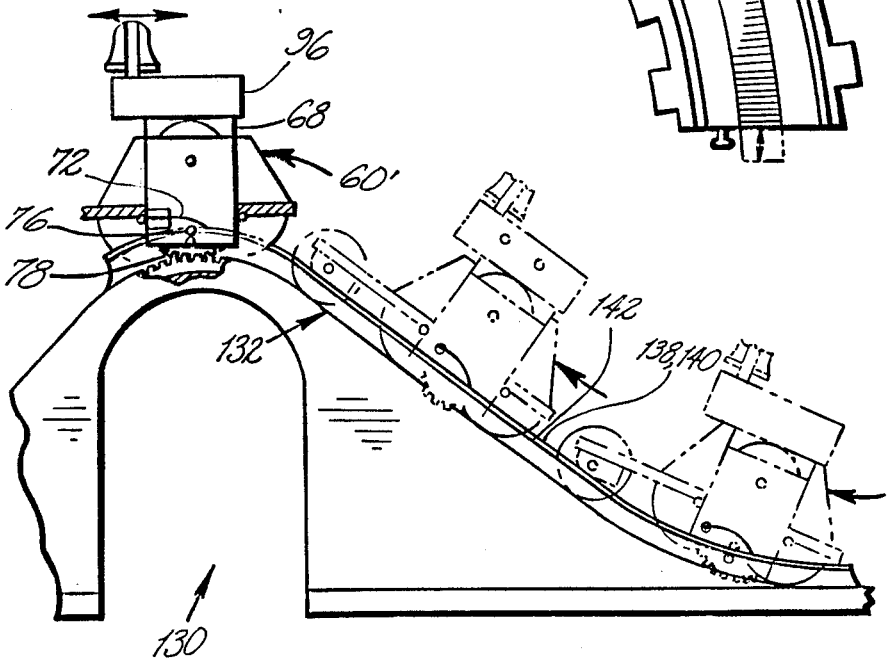

MOTORLESS TOY VEHICLE AND PROPELLING TRACK

BACKGROUND OF THE INVENTION

This invention relates generally to toy vehicles, and more particularly to a motorless toy vehicle propelled by the track on which it operates.

It is well known to propel motorless toy vehicles along a path or track either manually or with the assistance of gravity. However, prior art also discloses certain U.S. patents which generally provide means for propelling toy vehicles along a track.

U.S. Pat. No. 3,559,334 to Beny discloses a toy vehicle and track section for moving the toy vehicle up an incline. This device includes a centrally disposed vehicle propelling member 18 which is made to rapidly oscillate by a motor wherein upwardly projecting flexible projections interengage the bottom portion of the toy vehicle.

U.S. Pat. No. 3,540,153 to Aoki relates to a track vehicle which is driven by an internal motor and held in position upon the track by guide wheels allowing the toy vehicle to run on inverted track sections.

The U.S. Patent to Frank, U.S. Pat. No. 2,782,730 discloses a toy train driven by an internal motor operable on a track having perforated rails which are engaged by a motor driven toothed gear for propelling the train.

U.S. Pat. No. 4,021,962 to Axryd discloses a toy moveable along a predetermined track made moveable along the track by the manual axial reciprocation of an elongated coil spring embedded within the track which acts upon a pivotally connected arm 5 to propel the toy.

An early U.S. Patent to Agor, U.S. Pat. No. 661,926 is directed to a toy trolley affixed onto an endless rack and drivable therealong by manual rotation of a drive gear which acts upon the endless toothed rack.

Sansome, in U.S. Pat. No. 4,537,577, discloses a toy vehicle driven by an internal motor along a track having structure for holding the vehicle on the track.

In U.S. Pat. No. 3,698,130 to Usami, the inventor there discloses an amusement device which includes an object moveable along a fixed track having an automatic turnaround section at each end of the track.

Because applicant's invention is related to the various ratchet means for controlling the one-way direction of rotation of a drive gear, reference is made to the following U.S. Patents which generally disclose devices of such function, although not similar to the present invention:

U.S. Pat. No. Re. 24,883 to Herr
U.S. Pat. No. 296,168 to Higley
U.S. Pat. No. 1,276,168 to Buchholz
U.S. Pat. No. 1,368,066 to Starr
U.S. Pat. No. 2,515,174 to Abrams
U.S. Pat. No. 4,182,203 to Drury.

The present invention provides a motorless toy vehicle which is propellable in either direction along a track having a moveable rack slideably disposed therein. The rack reciprocates manually back and forth within the track and engages and acts upon a gear drive and preselectable ratchet means.

BRIEF SUMMARY OF THE INVENTION

This invention is directed to a motorless toy vehicle and propelling track. The toy vehicle includes a gear housing having a drive system operably mounted therein, the drive system including a drive gear and a ratchet means for controlling the direction of rotation of the gear drive. The track is adapted to receive and laterally direct the toy vehicle as it passes therealong and includes a slidably mounted rack coextensive with the track. The rack has upwardly disposed teeth therealong which operably engage with the drive gear. A rack drive reciprocates the rack back and forth in the track interacting with the ratcheted drive gear to propel the toy vehicle in the direction determined by the position of the ratchet means. Hill and switch tracks are also provided.

It is therefore an object of this invention to provide a motorless toy vehicle and propelling track for propelling the toy vehicle in either direction along the track.

It is another object of this invention to provide a motorless toy vehicle and propelling track having a unique drive system for propulsion.

It is yet another object of this invention to provide a motorless toy vehicle and propelling track which will propel the vehicle along the track at a variable speed in either direction.

It is yet another object of this invention to provide a unique pawl and ratchet arrangement for use in conjunction with, for example, a motorless toy vehicle and propelling track.

It is yet another object of this invention to provide a motorless toy vehicle and segmented propelling track whose segments may be easily assemblable into various track configurations.

It is yet another object of this invention to provide a motorless toy vehicle and propelling track which incorporate a fully functional hill track and switching track.

In accordance with these and other objects which will become apparent hereinafter, the instant invention will now be described with reference to the accompanying drawings in which:

BRIEF DESCRIPTION OF THE DRAWINGS

FIG. 1 is an enlarged perspective view of one end portion of a length of track having a rack slidably disposed therein.

FIG. 2 is a top plan view of the entire end configurations of two adjacent tracks showing their mateable engaging structure one to another.

FIG. 3 is a section view in the direction of arrows 3-3 in FIG. 2.

FIG. 4 is a perspective view of the preferred embodiment of the rack drive of the invention.

FIG. 5 is a top plan partially broken view of FIG. 4 showing a toy vehicle in phantom atop the track.

FIG. 11 is a top plan view of the preferred embodiment of the switch track.

FIG. 12 is a section view in the direction of arrows 12—12 in FIG. 11.

FIG. 13 is an enlarged perspective view of the track selector of FIG. 11.

FIG. 14 is a side elevation schematic view of the hill track depicting the toy vehicle in schematic traveling thereover.

DETAILED DESCRIPTION OF THE INVENTION

Figure 6:
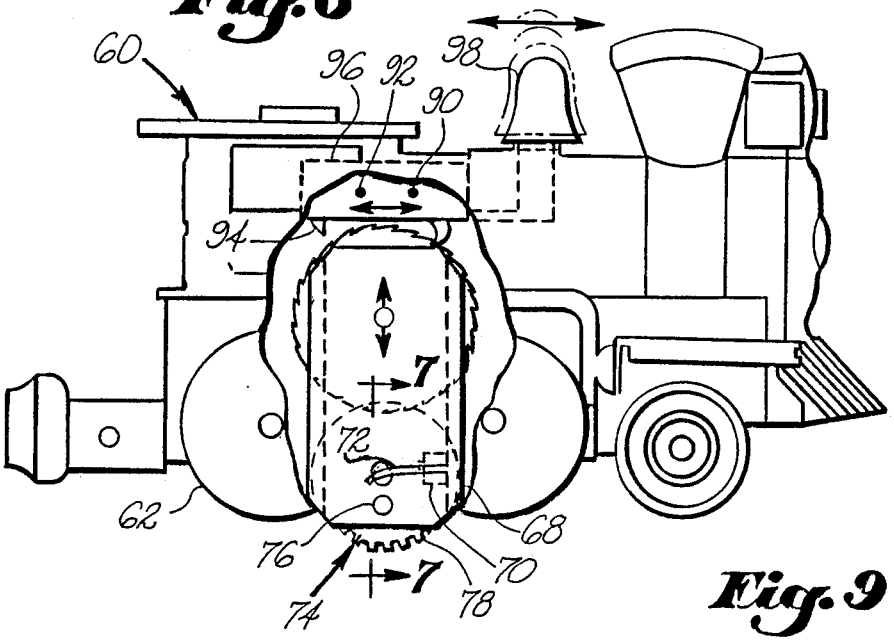
FIG. 6 is a side elevation partially broken view of the preferred embodiment of the toy vehicle.

Referring now to the drawings, and particularly to FIGS. 1, 2 and 3, the preferred embodiment of the track assembly is shown generally at 10 and includes a length of track 12 having an inverted T-slot 14 disposed along its entire length. This T-slot 14 is adapted to slidably receive rack 16 having upwardly disposed teeth 20 which extend substantially transversely across the mid-portion of the rack 16 but leaving the edges 18 free of teeth 20 so as to lockably engage within T-slot 14 as shown.

Although the track assembly 10 may be made of a continuous or endless loop of the structure above described, the preferred embodiment of the invention is provided in both straight and curvilinear sections so that the user may dispose the track assembly 10 on a flat surface in any desired configuration. To couple each of the adjacent track sections 12 together, as best seen in FIGS. 2 and 3, engaging lugs 22 are provided disposed at each end of the track section 12 which mateably engage, when the adjacent track sections 12 are twisted together, into mateing cavities 24 disposed into the bottom surface of each track section 12. This arrangement affords quick assembly and disassembly while also providing the necessary close interengagement between abuting adjacent racks 20 for smooth propulsion of the toy vehicle to be described herebelow.

Referring now to FIGS. 4 and 5, the energizing or propelling portion of the track assembly is there shown generally at 30 and is referred to as a rack drive. This rack drive 30 includes a length of track 32 which may be curvilinear or straight. As with all track sections, this track section 32 includes a rack 34 which is slidably engageable therein longitudinally back and forth in the direction of the arrows. However, the rack drive 30 also includes a platform 36 onto which a gear arrangement 40 is rotatably and operably mounted as shown. Handle 42 is provided to allow the user to effect propelling the toy vehicle (shown in phantom generally at numeral 60) along the track assembly. This is accomplished by rotating handle 42 which also causes gears 44, 46 and 48 to rotate in their well-known manner. Elongated rigid link 50 is pin connected at one end to gear 48 eccentrically at pin 52. The other end of link 50 is pin connected to the rack 34 at 54. Thus, regardless of which direction handle 42 is rotated, rack 34 is driven longitudinally back and forth a predetermined reciprocating distance A as shown in FIG. 5.

Figure 7:
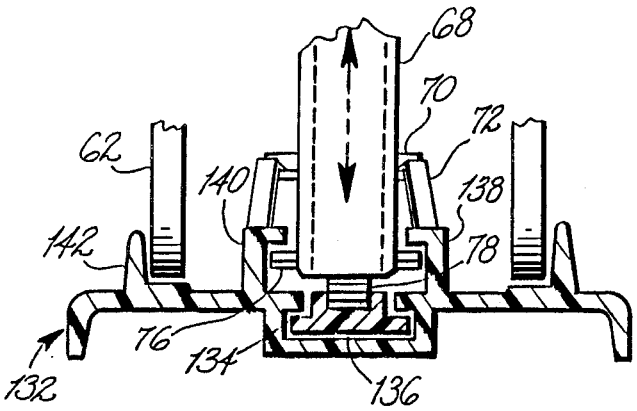
FIG. 7 is a section view in the direction of arrows 7—7 in FIG. 6 showing the toy vehicle atop a section of hill track shown in section, the hill track shown in FIG. 14.

Referring now to FIGS. 6 and 7, the preferred embodiment of the toy vehicle is shown generally at 60 in the form of a miniature train engine. Various accessory cars may be attached thereto in a well known manner to form an entire train. Although the toy vehicle 60 of the present invention is non-motorized, it does include a gear system 74 which is operably mounted within gear housing 68. The gear housing 68 is slidably mounted within the toy vehicle 60 so that it will freely translate vertically in the direction of the arrows.

The toy vehicle 60 also includes rotatably mounted main wheels 62 and front wheels 64. The front wheels 64 are axle mounted, (not shown) the axle being mounted at its mid-portion to the toy vehicle 60 and allowed to be laterally disposed to accommodate track curvature. Coil springs mounted over the front wheel 64 axle (not shown) return the front wheels 64 to a symetric position about the center line of the toy vehicle 60 on straight sections of the track.

Figure 9:
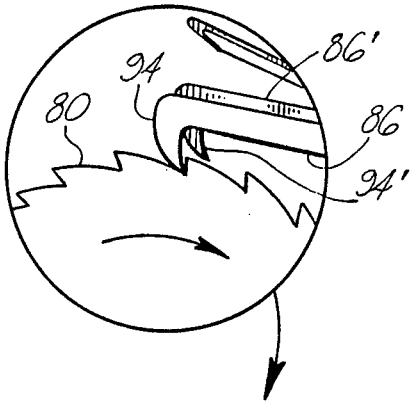
FIG. 9 is an enlarged front elevation view of the right hand pawl and ratchet wheel of FIG. 8 depicting the dual offset structure of the preferred embodiment of the pawl.
Figure 10:
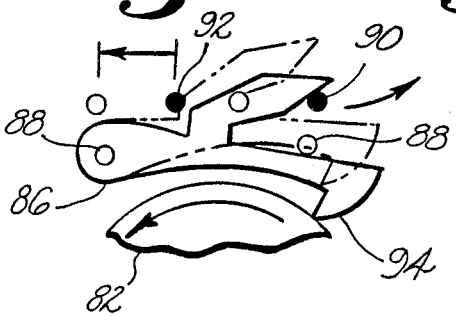
FIG. 10 is an enlarged back elevation view of the left hand pawl and ratchet wheel of FIG. 8.
Figure 8:
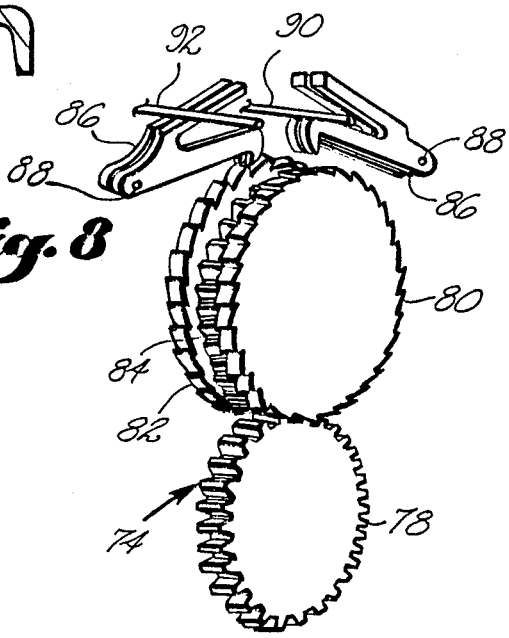
FIG. 8 is a perspective view of the preferred embodiment of the drive system.

Referring additionally to FIGS. 8, 9 and 10, the drive system 74 is there described in detail. Lower drive gear 78 is mounted for rotation within gear housing 68 and is disposed so as to engage the teeth of rack 134 when the toy vehicle 60 is disposed atop track 132. Drive gear 78 is also engaged with intermediate gear 84 which is also mounted for rotation within gear housing 68 immediately above drive gear 78. Intermediate gear 84 also includes ratchet wheels 80 and 82 mold formed integrally with, and disposed on either side thereof as shown. These ratchet wheels 80 and 82 have oppositely disposed teeth for alternate engagement with a pair of pawls 86.

Each pawl 86 is pivotally mounted within gear housing 68 along pin 88. These pawls 86 are opposingly mounted so that the distal end 94 of each pawl 86 may engage the teeth on the respective ratchets 80 and 82. As best seen in FIG. 10 wherein only one pawl 86 is shown for clarity, a pair of parallel spaced control rods 90 and 92 are rigidly disposed within slide 96 which is, itself, held for lateral translation with respect to gear housing 68 in toy vehicle 60. Decorative bell 98 is interconnected to slide 96 such that, when it is moved fore and aft in the direction of the arrows, slide 96 is, likewise disposed.

In viewing FIGS. 8 and 10, when slide 96, carrying control rods 90 and 92, is slid to the right, pawl 86 (in solid) engages ratchet wheel 82 and disengages pawl 86 from a ratchet wheel 80. However, when slide 96 is disposed in the opposite direction to the left, pins 90 and 92 disengage pawl 86 (in phantom) from ratchet wheel 82 and engage the other pawl 86 (not shown) into ratchet wheel 80. By this arrangement, then, the direction of rotation of drive gear 78 is controlled. An intermediate setting is provided for slide 96 wherein both pawls 86 are disengaged and drive wheel 78 will free wheel.

PROPULSION OF TOY VEHICLE

Having fully explained the drive system and structure of the toy vehicle and the structure of the track/rack assembly, it should be now clear that, to propel the vehicle, the rack needs merely to be oscilitated or reciprocated by rack drive 40 back and forth within the track when the toy vehicle is placed thereatop. Drive gear 78, when allowed to rotate in only one direction by the arrangement of pawls 86, freely rotates in one direction corresponding with one direction of movement of the rack; however, when the rack reciprocates back in the opposite direction, drive gear 78, being restricted in movement, then causes the toy vehicle 60 to be propelled a distance equal to the stroke of the rack. Further, it should be now understood that the user, by regulating speed of rotation of handle 42 of the rack drive 40, thus controls the speed of which the toy vehicle 60 is propelled along the track.

A further refinement of the ratchet and pawl arrangment (only one ratchet wheel and pawl shown for clarity) can be seen in FIG. 9. Generally, the teeth of ratchet wheel 80 may only be made to a certain minimum size without jeopardizing the durability of these teeth. However, it is desirable to provide a finer increment of ratcheting than the spacing between these durable-sized ratchet wheel 80 teeth provide. This is accomplished by providing a staggered connected pair of pawls 86/86' wherein the ratchet wheel tooth engaging portions 94 and 94' are provided connected adjacent one another and spaced apart approximately the width of one half of a ratchet wheel tooth. It should be understood that the overall thickness of the combination of pawl portions 94 and 94' is such as to both be engageable separately against the thickness of the ratchet wheel 80 teeth. Thus, one portion 94 or 94' of pawls 86 and 86' will engage the ratchet wheel 80 to prevent rotation, as here in FIG. 9, wherein the ratchet wheel 80 will only rotate in the direction of the arrow when either pawl portion 94 or 94' is engaged.

Referring now to FIGS. 11, 12 and 13, a switch track is generally shown at 100 and includes a main track portion 102 and a side track portion 106. The main track portion 102 includes rack 104 slidably disposed along its entire length, while side track portion 106 includes rack 108 whose end 112 engages against and within a mating notch 110 and rack 104. Thus, as rack 104 is reciprocated by the rack drive 40 previously described, rack 108 is driven to the right by mateing engagement with notch 110. However, rack 108 is made to return and follow in contact with notch 110 by tensioned spring 118 connected at its ends between pin 114 mounted in track 106 and pin 116 mounted in rack 108. Thus, rack 108 experiences the same reciprocating back and forth movement of main rack 104.

Switch track 100 includes a direction control bar or track selector 120 which may be pivotally positioned by handle 122 which supports and is pivotally mounted in switch track portion 124 as shown in FIG. 13. Thus, by manual manipulation of handle 122, the track selector bar 120 may be positioned against stops (not shown) to direct the toy train 60 along either the main track 102 or the side track 106. It should be here noted that, generally the side track may either be dead ended or loop around to merge into the main track by the use of another switch track 100 elsewhere.

Referring lastly to FIGS. 7 and 14, a hill track is shown generally at 130 and includes a track 132 formed in compliance with the shape of the hill track 130. The schematic of the toy vehicle is shown generally at 60' for enhanced understanding of the additional structure which is provided to ensure that the toy vehicle 60 traverses the hill track 130 smoothly. Two problems are generally encountered. First, the weight of the toy vehicle 60 may not be sufficient to keep drive gear 78 in contact with the teeth of rack 136. Thus, slipage occurs. Secondly, the toy train 60 may have a tendency to slide backwards when traversing the hill track 130.

Both of these problems have been attended to in additional structure for use in conjunction specifically with hill tracks 130. In order to insure that drive gear 78 remains in full engagement with rack 136, guide pin 76 is rigidly mounted in gear housing 68 and freely moves vertically within the toy vehicle 60 as previously described. This guide pin 76 slidably translates along and within mateing T-slot portions 138 and 140 which are formed integral with track 132 as it traverses the hill track 130. Only limited clearance is provided with the inner surface of mateing T-slot portions 138 and 140 vis-a-vis guide pin 76 so that free sliding translation is facilitated without disengagement of drive gear 78 from rack 136.

As the toy vehicle 60' traverses the hill track 130, gear housing 68 is pulled downwardly to its maximum at the most convex bottom portion of the hill by guide pin 76 and is pushed upward its maximum amount by drive gear 78 against rack end 34 at the most convex top of the hill track 130. Thus, by this free vertical translation of gear housing 68 within the toy vehicle 60', full engagement between the drive gear 78 and the rack 134 is maintained.

To prevent sliding rearward, at least one leaf spring 72 cantilever mounted within bosses 70 is provided. As best seen in FIGS. 6, 7 and 14, this leaf spring 72, when pressing against the top surface of T-slot portions 138 and 140, digs in to prevent such rearward motion.

With regard to the rack drive shown and previously described with respect to FIGS. 4 and 5, it should be here noted that, although the preferred embodiment is a manual device as there shown, an electric driven motor interconnected to and driving gear 48 or its equivalent will serve the same function and be within the scope of this invention. This motorized replacement for the rack drive nonetheless still deems the toy vehicle of the present invention to be motorless.

While the instant invention has been shown and described herein in what is conceived to be the most practical and preferred embodiment, it is recognized that departures may be made therefrom within the scope of the invention, which is therefore not to be limited to the details disclosed herein, but is to be accorded the full scope of the claims so as to embrace any and all equivalent apparatus and articles.

What is claimed is:

1. A toy vehicle and propelling track comprising:

a motorless toy vehicle including a gear housing having a drive system mounted therein:

said drive system including a drive gear mounted for rotation in said gear housing and a two way ratchet means for allowing said gear drive to rotate only in a first direction, only in a second direction opposite to said first direction, or to freely rotate in either direction;

a track adapted to support and to laterally direct said toy vehicle as it passes therealong;

said track having a coextensive rack slidably mounted therein, said rack adapted to freely move in at least a limited reciprocating back and forth motion within said track and having spaced apart upwardly disposed teeth;

said drive system adapted, within said toy vehicle, to engage said drive gear and said rack teeth when said toy vehicle is placed atop said track;

a rack drive operably connected to said rack and adapted to controllably reciprocate said rack back and forth within said track;

said toy vehicle propelled by said reciprocating rack in a first direction along said track when said ratchet means is positioned to allow said drive gear to rotate only in said first direction;

said toy vehicle propelled by said reciprocating rack in a second direction opposite to said first direction along said track when said ratchet means is positioned to allow said gear drive to rotate only in said second direction;

said toy vehicle moveable freely in either direction along said track when said ratchet means is positioned to allow said gear drive to freely rotate.

2. A toy vehicle and propelling track as set forth in claim 1, wherein:

said track is endless.

3. A toy vehicle and propelling track as set forth in claim 2, wherein said ratchet means comprises:

a pair of opposing pawls pivotally mounted on said gear housing;

a ratchet wheel integrally formed on either side of, and coaxially mounted with, said drive gear;

each said pawl of said pair selectively engageable, one at a time, with one said ratchet wheel to allow said drive gear to rotate only in one direction at a time;

both of said pawls of said pair also selectively disengageable simultaneously to allow said drive gear to freely rotate.

4. A toy vehicle and propelling track as set forth in claim 3, wherein:

each said pawl of said pair includes two offset gear drive engaging portions staggered apart generally one half the distance between adjacent teeth of said drive gears.

5. A toy vehicle and propelling track as set forth in claim 4, further comprising:

an intermediate gear mounted for rotation in said gear housing and operably engaged to and above said drive gear;

said intermediate gear including said ratchet wheels which are positioned above said drive gear on said second drive gear for clearance.

6. A toy vehicle and propelling track as set forth in claim 2, further comprising:

at least one anti-reverse leaf spring cantilever mounted at one end to said gear housing and shaped to be spring biased at its other end against said track to resist rearward movement of said toy vehicle when atop said track.

7. A toy vehicle and propelling track as set forth in claim 2, wherein said rack drive includes:

a hand crank mounted for manual rotation adjacent one portion of said rack;

an intermediate gear arrangement mounted for rotation adjacent said track and operably engaged for driven rotation by said hand crank;

a driving link pivotally connected at one end to said intermediate gear arrangement and pivotally connected at its opposite end to said rack;

said intermediate gear arrangement adapted, when rotatably driven by said hand crank, to articulate said drive link causing said rack to reciprocate within said track.

8. A toy vehicle and propelling track as set forth in claim 7, wherein rate of rotation of said hand crank regulates speed of said toy vehicle propelled along said track.

9. A toy vehicle and propelling track as set forth in claim 2, wherein said track further includes:

a hill track formed into a portion of said track, said rack flexibly extending therealong;

said hill track having a T-slot disposed above said rack and extending along substantially the entire length of said hill track;

said gear housing also including a transverse guide pin extending laterally in either direction adapted to slidably translate within said T-slot;

said gear housing freely movable vertically within said toy vehicle to accommodate the vertical curvatures forming said hill track and to maintain said drive gear in operable communication with said rack as said toy vehicle is propelled by said rack over said hill track;

said gear housing further including at least one anti-reverse leaf spring cantilever mounted at one end to said gear housing and shaped to spring biasingly dispose its other end against the top of said T-slot to resist rearward movement of said toy vehicle as it is propelled over said hill track.

10. A toy vehicle and propelling track as set forth in claim 2, wherein said track further includes:

a switch track forming first and second branches forming one end thereof, said first branch forming a portion of said main, continuous track which interconnectes to the other end of said switch track, said second branch forming a portion of a side track;

said rack portion in said side track operably engaged against and driven in one direction of reciprocation by said rack portion in said main track;

said side track rack portion driven in the opposite direction of said reciprocation and kept in operable communication with said main track rack by an elastic member interconnected between said switch track and said track rack;

a branch selector operably connected to said switch track having a first and second position and adapted to direct said toy vehicle along said main track in said branch selector first position and to direct said toy vehicle along said side track in said branch selector second position.

11. A toy vehicle and propelling track as set forth in claim 2, wherein:

said track is formed of a plurality of generally straight and curvilinear track segments adapted to releasably interengage one another in end-to-end fashion;

each said track segment having a coextensive rack segment slidably mounted therein;

one said rack segment operably connected to said rack drive.

12. A toy vehicle and propelling track comprising:

a motorless toy vehicle including a gear housing having a drive system mounted therein:

said drive system including a drive gear mounted for rotation in said gear housing and a two way ratchet means for allowing said gear drive to rotate only in a first direction, only in a section direction opposite to said first direction, or to freely rotate in either direction;

said ratchet means including a pair of opposing pawls pivotally mounted on said gear housing, a ratchet wheel integrally formed on either side of, and coaxially mounted with, said drive gear;

each said pawl of said pair selectively engageable, one at a time, with one said ratchet wheel to allow said drive gear to rotate only in one direction at a time;

both of said pawl of said pair also selectively disengageable simultaneously to allow said drive gear to freely rotate;

each said pawl of said pair including two offset gear drive engaging portions staggered apart generally one half the distance between adjacent teeth of said drive gears;

at least one anti-reverse leaf spring cantilever mounted at one end to said gear housing and shaped to spring biasingly dispose its other end against said track to resist rearward movement of said toy vehicle atop said track;

a track adapted to support and to laterally direct said toy vehicle as it passes therealong;

said track having a coextensive rack slidably mounted therein, said rack adapted to freely move in at least a limited reciprocating back and forth motion within said track and having spaced apart upwardly disposed teeth;

said drive system adapted, within said toy vehicle, to engage said drive gear and said rack teeth when said toy vehicle is placed atop said track;

a rack drive operably connected to said rack and adapted to controllably reciprocate said rack back and forth within said track;

said toy vehicle propelled by said reciprocating rack in a first direction along said track when said ratchet means is positioned to allow said drive gear to rotate only in said first direction;

said toy vehicle propelled by said reciprocating rack in a second direction opposite to said first direction along said track when said ratchet means is positioned to allow said gear drive to rotate only in said second direction;

said toy vehicle moveable freely in either direction along said track when said ratchet means is positioned to allow said gear drive to freely rotate said rack drive including a hand crank mounted for manual rotation adjacent one portion of said track, an intermediate gear arrangement mounted for rotation adjacent said track and operably engaged for driven rotation by said hand crank, a driving link pivotally connected at one end to said intermediate gear arrangement and pivotally connected at its opposite end to said rack;

said intermediate gear arrangement adapted, when rotatably driven by said hand crank, to articulate said drive link causing said rack to reciprocate within said track;

rate of rotation of said hand crank regulating speed of said toy vehicle propelled along said track;

a hill track formed into a portion of said track, said rack flexibly extending therealong;

said hill track having a T-slot disposed above said rack and extending along substantially the entire length of said hill track;

said gear housing also including a transverse guide pin extending laterally in either direction adapted to slidably translate within said T-slot;

said gear housing freely movable vertically within said toy vehicle to accommodate the vertical curvatures forming said hill track and to maintain said drive gear in operable communication with said rack as said toy vehicle is propelled by said rack over said hill track;

said gear housing further including at least one anti-reverse leaf spring cantilever mounted at one end to said gear housing and shaped to spring biasingly dispose its other end against the top of said T-slot to resist rearward movement of said toy vehicle as it is propelled over said hill track;

a switch track forming first and second branches forming one end thereof, said first branch forming a portion of said main, continuous track which interconnectes to the other end of said switch track, said second branch forming a portion of a side track;

said rack portion in said side track operably engaged against and driven in one direction of reciprocation by said rack portion in said main track;

said side track rack portion driven in the opposite direction of said reciprocation and kept in operable communication with said main track rack by an elastic member interconnected between said switch track and said track rack;

a branch selector operably connected to said switch track having a first and second position and adapted to direct said toy vehicle along said main track in said branch selector first position and to direct said toy vehicle along said side track in said branch selector second position;

said track is formed of a plurality of generally straight and curvilinear track segments adapted to releasably interengage one another in end-to-end fashion;

each said track segment having a coextensive rack segment slidably mounted therein;

one said rack segment operably connected to said rack drive.

* * * * *